United States Patent [19]

Harlow et al.

[11] 4,250,513

[45] Feb. 10, 1981

[54] LINEAR VERTICAL ADJUSTMENT MECHANISM

[75] Inventors: James L. Harlow, Mt. Solon; Ward L. Karns, Waynesboro, both of Va.

[73] Assignee: General Electric Company, Waynesboro, Va.

[21] Appl. No.: 77,001

[22] Filed: Sep. 19, 1979

[51] Int. Cl.[3] ..... G01D 15/06

[52] U.S. Cl. ..... 346/153.1; 118/623; 118/658

[58] Field of Search ..... 346/153, 155–156, 346/139 R, 165; 118/623, 656–658; 74/84 R; 15/370, 21 B

[56] References Cited

U.S. PATENT DOCUMENTS

| | | | |
|---|---|---|---|
| 3,358,637 | 12/1967 | Shearer et al. | 118/658 |
| 3,628,504 | 3/1970 | Richmond | 118/656 |
| 3,778,842 | 9/1971 | Saito | 346/139 R |
| 3,945,343 | 3/1976 | Berkowitz | 118/623 |
| 4,128,079 | 12/1978 | Suzuki | 118/658 |
| 4,157,554 | 6/1979 | Bahr et al. | 346/153 |

*Primary Examiner*—Alfred H. Eddleman
*Attorney, Agent, or Firm*—Michael Masnik

[57] ABSTRACT

This invention relates to a linearly adjustable support mechanism in general, and more specifically to an apertured adjustment disc which provides a plurality of incremental linear, vertical adjustments, with no horizontal component, to raise and lower a supported member. This device has particular significance in a printing environment to align an ink or toner applicator member, such as a magnetic ink brush, with respect to a recording head or recording medium to insure that the magnetic brush will be parallel to the surface of the recording head or recording medium, to prevent the occurrence of a print intensity gradient in one instance or apply a uniform coating to the recording member in the other instance.

11 Claims, 5 Drawing Figures

FIG. 1
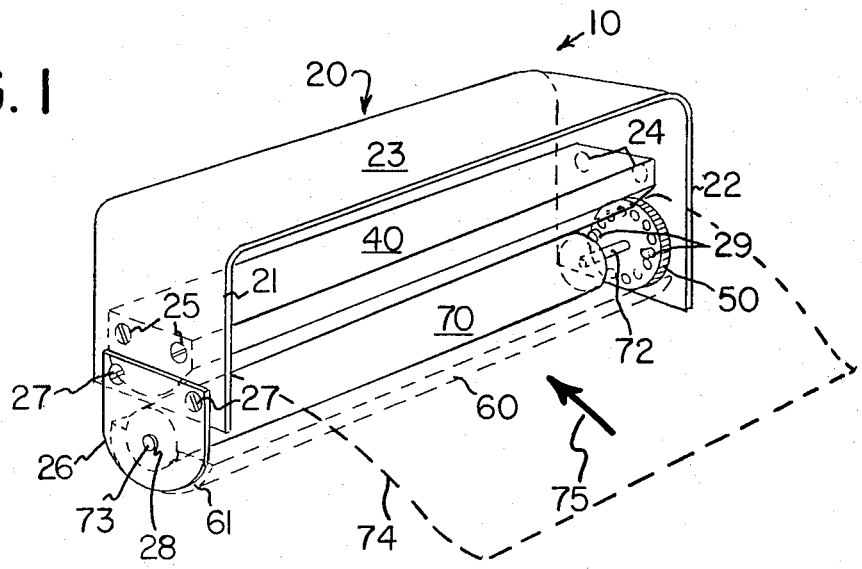
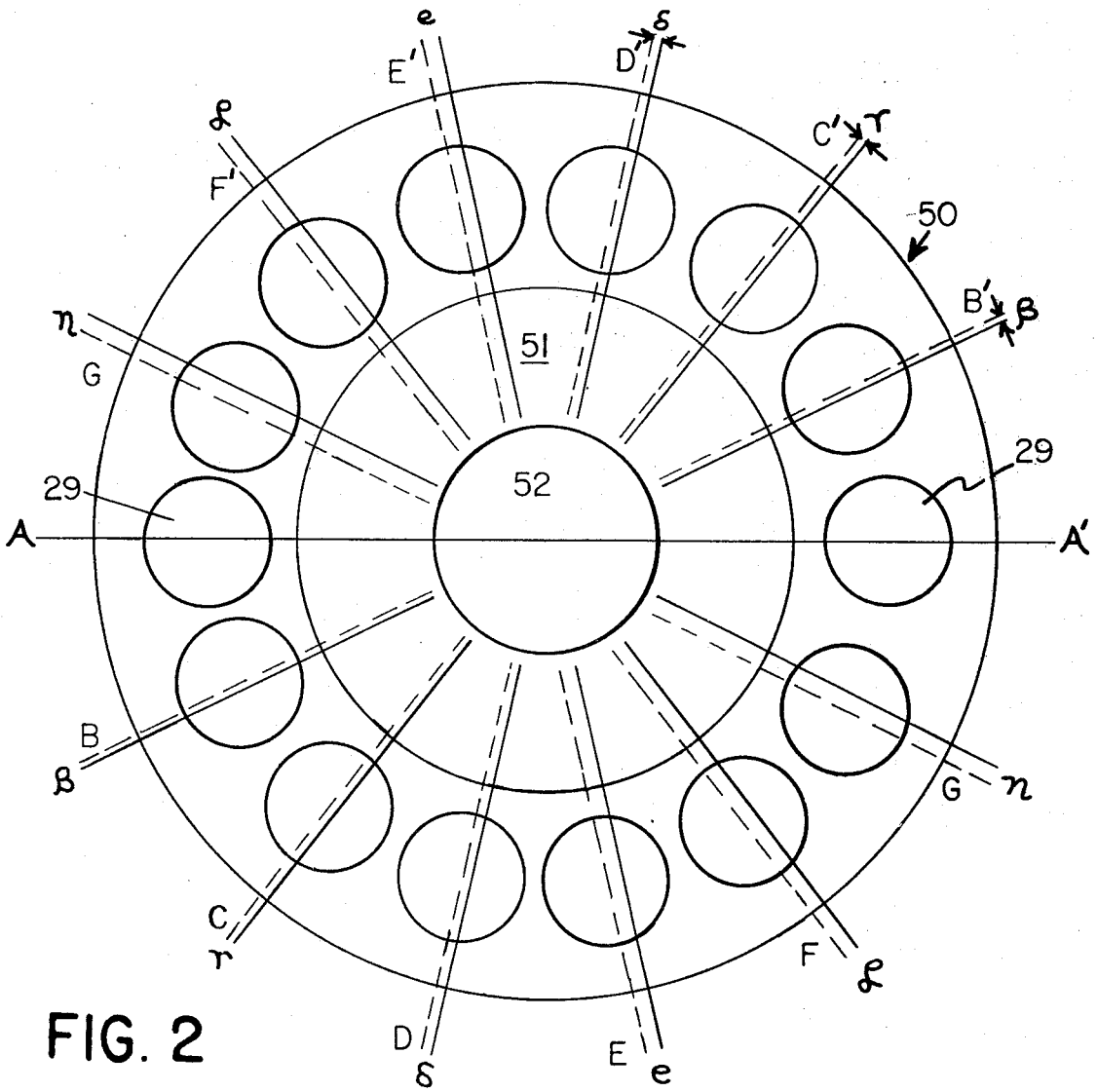
FIG. 2

LINEAR VERTICAL ADJUSTMENT MECHANISM

BACKGROUND OF THE INVENTION

In the area of technology which relates to printing, such as facsimile, xerography, magnetography, etc., a standard procedure is one in which a uniform coating such as ink or toner is selectively applied on a recording medium that is adjacent to a recording head via a toner applicator such as a magnetic brush. The recording head in one form of printing system would be a write head which is capable of providing magnetic latent images of symbols, such as alpha-numeric characters, on a recording medium in a straight line configuration. The recording medium may be an endless loop of magnetic tape moving between the write head and a magnetic brush, and the ink or toner on the brush will be magnetically attracted to the recording medium in response to the magnetic output of the write head. In most xerographic systems the toner applicator is in direct contact with a photoreceptor surface to selectively coat the surface with toner. Depending on the system employed, the toner applicator may be in the form of a magnetic brush, fur brush, roller, etc. For further details of such a magnetographic system, reference can be made to U.S. Pat. No. 3,945,343 dated Mar. 23, 1976 and assigned to the common assignee.

Regardless of the form of the components in a given printing system, some parallelism must be achieved between the respective parts to insure that a uniform thickness of ink or toner is applied over the contact length of the parts, adjacent to, or on, a given receptor surface by the toner applicator.

Even though this condition is common in both xerographic and magnetographic systems, it is less of a problem in a xerographic environment due to the relatively larger forces involved in the recording method.

In a magnetographic system the attractive forces between the recording medium and the toner on the magnetic brush are much smaller and parallelism between the respective parts becomes critical.

A magnetographic system may employ a magnetic rotating brush in a toner reservoir for applying toner particles to a moving surface of a recording medium. As the brush is rotated a uniform layer of toner selectively covers the moving surface of a recording medium where latent images have been recorded. If the surface of the recording medium is not parallel to the axis of rotation of the magnetic brush, a print intensity gradient will appear on the recording medium, such as magnetic recording tape.

The gradient is due to the fact that toner is attracted by both the magnetic field of the brush and the field of the magnetic latent images on the recording medium. The recording medium passes through the mantle of toner particles surrounding the magnetic brush. The magnetic portions of the recording medium closest to the axis of rotation of the brush will receive proportionately lesser amounts of magnetic ink or toner than those magnetic portions of the recording medium more remote from the axis of rotation because the magnetic attractive force of the brush closest to the brush axis is stronger and impedes transfer of toner to the magnetic latent images on the tape.

While the horizontal alignment accuracy of the brush along the magnetic tape surface can be readily obtained, the problem of vertical alignment accuracy of the axis of rotation of the brush in parallel with the recording medium has not been easy to solve. Due to machine design limitations any adjustment mechanism incorporated into the machine should be compact, uncomplicated, simple to manipulate and accurate.

To solve this problem it has been necessary to develop a linear vertical axial adjustment mechanism with no horizontal component, which will insure parallelism between the axis of rotation of the magnetic brush and the recording medium. Some of the specific solutions which were investigated are: a screw jack and slider mechanism, which was subject to backlash and found to be too complicated for the intended purpose; and eccentric washer shaped, continuously rotatable discs, which had unacceptable horizontal movement for every vertical adjustment.

A structure was needed to produce an incremental, linear, vertical, axial adjustment without any horizontal component, which was simple to operate, compact, reproducible, reliable, and accurate while being of relatively low cost.

SUMMARY OF THE INVENTION

An object of the present invention is to provide a simple, accurate, linear adjustment mechanism.

Another object of the invention is the provision of an adjustment mechanism which linearly adjusts one end of a magnetic brush member with respect to a recording medium.

A further object of the invention is the provision of an adjustment mechanism in the form of a rotatable apertured disc which is designed to support and adjust one end of a magnetic brush with respect to a recording medium, without lateral movement.

Still another object of this invention is the provision of an incremental linear, vertical adjustment mechanism for a printing device, which can be manipulated by a machine assembler to obtain parallelism between the axis of rotation of a toner applicator brush and a printing medium to prevent print intensity gradients.

A still further object of this invention is the provision of a linear, vertical adjustment mechanism for a magnetographic printing assembly which is totally unique in the orientation of a plurality of opposed aperture pairs disposed about the periphery of the mechanism and progressively offset from its axis.

These and other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of the adjustment mechanism as it would be installed in a printing machine.

FIG. 2 is an enlarged detailed view of the offset opposed aperture pairs of the adjustment disc illustrating the progressive increments of linear adjustments available through the use of this invention.

DESCRIPTION OF THE PREFERRED EMBODIMENT

Figure 3:
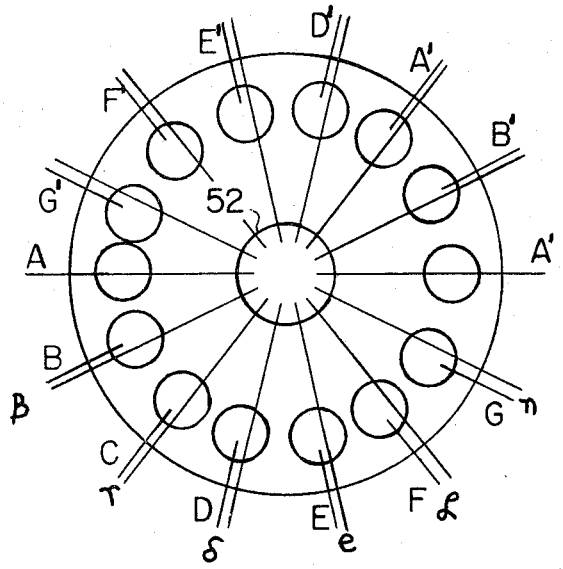
FIG. 3 is a front view of the rotatable adjustment disc with the supporting opposed aperture pairs aligned with the axis of the shaft receiving central aperture.

In FIG. 1 there is shown a supporting structure 10 for a magnetic recording system comprising an elongated generally U-shaped support bracket 20 having a first depending portion 21, and a second depending portion 22, which are joined by a flat elongated intermediate portion 23, and both depending portions 21, 22 have one or more axially aligned apertures 24 to receive securing means 25 to suspend and support a recording head 40, such as a magnetic recording head, beneath the elongated intermediate portion 23. A magnetic brush 70 physically contacts a recording medium, such as an endless loop of magnetic tape 74 (shown in dotted form) which is in mutual contact with the recording head 40 and the brush 70 and is moved in the direction of arrow 75. The recording head 40 responds to signals not shown to record a line of corresponding latent magnetic images on the tape 74. The tape moves through the mantle of magnetic particles delivered by the rotating magnetic brush 70 from a reservoir 60 shown in dotted line. The latent magnetic images attract the magnetic toner particles.

Attached to and depending below the first depending portion 21 is an end plate member 26. The end place member 26 is removably secured to the first depending portion 21 via a plurality of securing means 27, and has a shaft receiving aperture 28 centrally disposed therein. Projecting inwardly from the second depending portion 22 are a pair of cylindrical mounting pins 29 which are equilaterally displaced from the axis of the shaft receiving aperture 28 when the end plate member 26 is secured to the first depending portion 21. The mounting pins 29 are disposed in the same horizontal plane on the second depending portion 22, and cooperate with an adjustment disc designated generally as 50 which forms the basis of this invention.

The adjustment disc 50 in FIG. 2 comprises a disc 51 having a centrally disposed shaft receiving aperture 52. A plurality of mounting holes, in the form of opposed pin receiving aperture pairs A, A', etc. are disposed on the periphery of the disc 51 and equilaterally spaced from the axis of the shaft receiving aperture 52.

In the preferred embodiment illustrated in FIG. 2, the adjustment disc 50 is provided with seven pin receiving, opposed aperture pairs A, A', B, B', C, C', D, D', E,E', F, F', G, G'. The only opposed aperture pair whose axes are in the same horizontal plane as the axis of the shaft receiving aperture 52 and which have diameters which coincide with a diameter of the adjustment disc is aperture pair A, A'. The solid lines radiating from the axis of the shaft receiving aperture 52 represent diameters drawn through the central axis of brush shaft receiving aperture 52 of the adjustment disc 50. The dashed lines converging towards but progressively offset from the axis of the shaft receiving aperture 52 represent center lines taken through the axes or centers of the respective opposed pairs displaced from the center of the aperture 52 by incremental, progressively increasing distances.

The remaining opposed aperture pairs B, B', C, C', etc. therefore have center lines (dashed lines) which are parallel to, and progressively offset from the center line (solid lines) of the aperture 52. The progressively offset distances, which are designated as $\beta$, $\tau$, $\delta$, etc., represent linear increments which comprise the adjustment range of the disc. By placing different aperture pairs on the mounting pins, the position of the shaft receiving aperture 52 is adjusted vertically with respect to the axis of the mounting pins the distance of the difference in the offset of the respective aperture pairs.

The brush 70 is rotatably disposed on a central shaft 72, 73 which is dimensioned to cooperate with the shaft receiving aperture 28 in the bracket 26 and shaft receiving aperture 52 in the adjustment disc 50 respectively, to support the brush 70 beneath the recording medium 74 and the recording head 40. Positioned beneath and encompassing the lower portion of the brush 70 is a receptacle 60 which provides toner by magnetic attraction to form a mantle of toner on the surface of the brush 70 .

One embodiment of brush is in illustrated in greater detail in the aforementioned patent.

The recording head 40 is affixed to the U-shaped bracket 20 via suitable securing means 25. The adjustment disc 50 is mounted on the mounting pins 29 by inserting the pins through aperture pairs A-A'. At this point the axis of the shaft receiving aperture 52 is aligned with the axes of the mounting pins 29. One end 72 of the central shaft is held in the aperture 52 of disc 50 and the other end 73 of the central shaft is held in aperture 28 of the end plate 26 which in turn is secured to the U-shaped bracket 20.

Once the printing support structure 10 has been assembled, and non-parallelism is discovered, the unique construction of the adjustment mechanism comes into play. To achieve parallelism between the brush 70 and the recording head 40, and the recording medium 74, end 72 of the central shaft is raised or lowered in the vertical plane with respect to end 73 as desired. After removing the end plate member 26 and the brush 70, the disc 50 may be removed from the support pins 29 and axially rotated above aperture 52 so that shaft end 72 is supported by a different set of aperture pairs, i.e. B-B'. After inserting shaft end 72 into aperture 52 and end plate 26 and brush 70 reattached to support 21, shaft end 72 will have been adjusted vertically the distance of the difference in the offset of the new mounting holes with respect to the old mounting holes.

Figure 4:
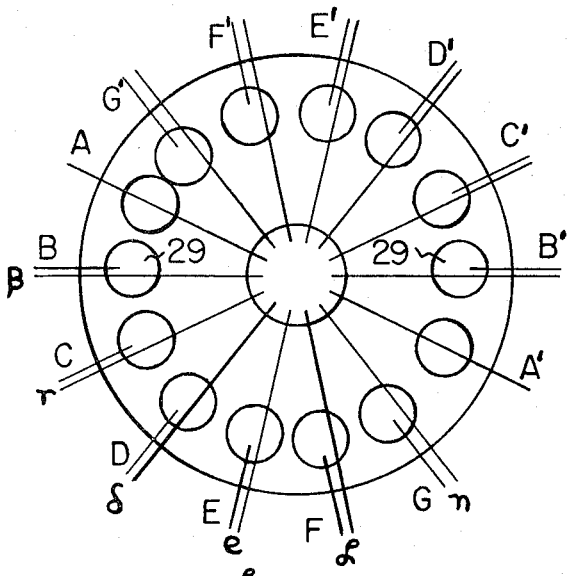
FIG. 4 is a front view of the disc with the axes of the supporting aperture pairs located above the axis of the shaft receiving aperture.
Figure 5:
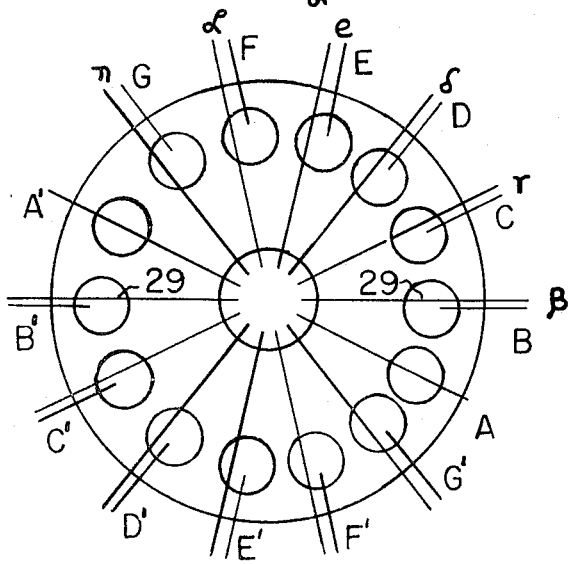
FIG. 5 is a front view of the disc with the axes of the supporting aperture pairs located below the axis of the shaft receiving aperture.

FIGS. 3 through 5 illustrate exactly how the rotation of the disc 50 causes the shift to be vertically translated. In FIG. 3 the axes of the shaft receiving aperture 52 and the aperture pair A-A' are in the same horizontal plane. By rotating the disc 50 in the clockwise direction as shown in FIG. 4 and inserting the mounting pins 29 in aperture pair B-B' the axis of the aperture 52 has been offset below the axes of the mounting pins by a distance $\beta$. This offset distance below the axes of the mounting pins increases as the succeeding aperture pairs are mounted on the pins, i.e. for aperture pair C-C' the offset distance would be $\nu$, for D-D' it would be $\delta$, etc. When the disc has been rotated 180° the axis of the aperture 52 is again aligned with the axes of the mounting pins, i.e. A'-A. Continued clockwise rotation of the disc to the position illustrated in FIG. 5, i.e. B'-B, vertically offsets the axis of the aperture 52 a distance $\beta$ above the axes of the mounting pins. The vertical increment increases as successive aperture pairs are employed until the disc has been rotated a full 180° from starting position A'-A.

The adjustment disc 50 provides incremental adjustment of end 72 of the central shaft in a linear manner without any horizontal component, and allows a machine assembler to easily achieve parallelism between the recording head 40 and the brush 70. Since the configuration of the particular magnetic printer in which this adjustment mechanism is employed places a premium on utilizable space, and cannot tolerate excess horizontal displacement of the reservoir/applicator with respect to the write head, the adjustment disc of the described invention provides a very accurate, uncomplicated, vertical adjustment device to achieve parallelism without inducing any horizontal component into the finally assembled unit.

To check for parallelism, an operator would run a test pattern through the printer unit to determine the density of toner particles attracted by the latent images on the recording medium 74. If the toner density is weaker at the end of the brush 70 supported by the adjustment disc, it would indicate that shaft end 72 would have to be vertically lower in relation to the center line of the mounting pins, and the machine assembler would rotate the disc to the position illustrated in FIG. 4, i.e. B-B', to vertically offset the axis of the shaft receiving aperture 52 a distance $\beta$ below the center line of the mounting pins. The test pattern and print intensity gradient may again be checked, and incremental rotation of the disc through successive aperture pairs would be employed until the toner density was uniform across a line of latent image on medium 74, which would indicate that parallelism had been achieved in the unit.

In the instance where the toner density is stronger at the end of brush 70 near the disc 50, the operator would initially rotate the disc to the position illustrated in FIG. 5, i.e. B'-B, to vertically offset the axis of the shaft receiving aperture 52 a distance $\beta$ above the axis of the mounting pins. The operator would repeat the procedure outlined supra until a uniform toner density is achieved.

It should be obvious that the aperture pairs shown in the drawings are for purposes of illustration only, and any number of aperture pairs could be provided on the disc by enlarging the diameter of the disc, and increasing the lateral spacing of the mounting pins, or in the alternative, the dimensions of the opposed aperture pairs and mounting pins could be reduced to accommodate additional aperture pairs. By increasing the number of aperture pairs either the total adjustment can be increased, or the individual offset distances can be decreased to provide a fine tuning adjustment mechanism over the device illustrated in FIGS. 1 through 5. The adjustment disc 50 may also be provided on both ends of the brush 70.

The incremental offset distances $\beta$, $\nu$, $\delta$, $\rho$, $\zeta$, $\eta$, etc., can have any value desired, arranged in any desired order but usually most conveniently in an ascending or descending order. In the preferred embodiment illustrated, the total linear vertical adjustment available is $\pm\eta$. The disc has a total adjustment range of twice the distance of the aperture pairs maximum offset to the axis of the central shaft receiving aperture. The incremental adjustment step distance depends on the differences between the progressively offset distances of the aperture pairs about the central aperture 52. The number of adjustment steps available depend on the number of aperture pairs in the disc, and that number is one less than the total number of apertures excluding the central aperture.

While the paired apertures of disc 50 are shown to be circular, one aperture of each pair may be elongated in a direction orthogonal to the direction of the desired incremental, linear adjustments, for example slotted, to accommodate mounting pin tolerances.

Having thereby disclosed the subject matter of this invention, it should be obvious that many modifications, substitutions and variations of the invention described are possible in light of the above teachings. It is therefore to be understood that the invention may be practiced other than as specifically described, and should be limited only by the breadth and scope of the appended claims.

What we claim as new and desire to secure by Letters Patent of the United States is:

1. A linear adjustment mechanism for use in a recording assembly to axially align a magnetic brush rotatable about a shaft with respect to the surface of a recording medium, comprising:

a bracket to support the axes of said brush with respect to the surface of said recording medium, a plurality of mounting pins projecting from said bracket, and a rotatable apertured disc disposed on said mounting pins and adapted to support one end of said shaft of said brush at a plurality of selectively incremental distances along only one axis with respect to said mounting pins upon rotation.

2. A linear adjustment mechanism as in claim 1 wherein said plurality of mounting pins are spaced from one another and disposed along the same center line passing through the centers of said pins.

3. A vertical adjustment mechanism as in claim 2 wherein said magnetic brush comprises:

a cylindrical applicator element rotatably mounted on a central shaft, and a toner reservoir for supplying toner to form a mantle of toner on the exterior of said brush element.

4. A linear adjustment mechanism as in claim 3 wherein said apertured disc has a centrally disposed aperture adapted to receive one end of said shaft of said brush, and a plurality of apertures disposed about the periphery of the disc in opposed pairs.

5. A linear adjustment mechanism as in claim 4 wherein only one of the opposed aperture pairs has a center line which coincides with a centrally disposed aperture of said disc.

6. A linear adjustment mechanism as in claim 5 wherein the remaining opposed aperture pairs have center lines which are progressively offset from the center of the centrally disposed aperture of said disc.

7. A linear adjustment mechanism as in claim 6 wherein each hole of the opposed aperture pairs are equilaterally spaced from the axis of the central aperture with respect to its paired hole.

8. A linear adjustment mechanism as in claim 6 wherein the center lines of the remaining opposed aperture pairs are progressively offset from the center of the centrally disposed aperture of said disc in linear increments along said only one axis.

9. A linear adjustment mechanism as in claim 8 wherein the number of the plurality of incremental linear distances available to the disc is one less than the number of paired apertures disposed about the periphery of the disc.

10. A printing arrangement comprising:

an elongated write head for producing a latent image of information along a line on a moving record medium in physical contact with said head, a cylindrical toner application member rotating about a shaft in pressure contact with said head through said record medium for developing said latent image, means for aligning said applicator member parallel to said write head comprising:

a bracket to support said applicator member shaft and said write head, a pair of spaced apart mounting pins projecting from said bracket, means for supporting one end of said applicator member shaft at a plurality of incremental vertical distances with respect to said mounting pins, said apertured disc comprising a centrally disposed aperture adapted to receive said one end of said central shaft, an apertured disc removably disposed on said mounting pins and adapted to support one end of said applicator member shaft, and a plurality of apertures disposed about the periphery of the disc in opposed pairs, each pair being spaced apart to mate with a corresponding one of said pins.

11. A printing arrangement comprising:

an elongated write head for producing a latent image of information along a line on a moving record medium in physical contact with said head, a cylindrical toner applicator member rotatable about a shaft in pressure contact with said head through said record medium for developing said latent image, means for aligning said applicator member with respect to said write head comprising a bracket to support said applicator member shaft and said write head, said bracket comprising a center line, means for supporting one end of said applicator member shaft at a plurality of incremental distances along one axis with respect to the center of rotation of said shaft and at a fixed distance with respect to an axis orthogonal to said one axis comprising an apertured disc removably disposed on said bracket, said apertured disc comprising a centrally disposed aperture adapted to receive said one end of said shaft and a plurality of apertures disposed about the periphery of the disc in opposed pairs, said opposed pairs of apertures being located such that rotation of said apertured disc causes the center line passing through each pair of apertures to be spaced from the center of said shaft said incremental vertical distances along said one axis.

* * * * *

UNITED STATES PATENT OFFICE

CERTIFICATE OF CORRECTION

Patent No. 4,250,513 Dated February 10, 1981

Inventor(s) James L. Harlow et al

It is certified that error appears in the above-identified patent and that said Letters Patent are hereby corrected as shown below:

Col. 4, line 53, cancel "ν" and insert --γ--
Col. 5, line 49, cancel "V" and insert --γ--
Col. 5, line 49, cancel "ρ" and insert --e--
Col. 5, line 49, cancel "ζ" and insert --ξ--

Signed and Sealed this

Fifth Day of October 1982

[SEAL]

Attest:

GERALD J. MOSSINGHOFF

Attesting Officer Commissioner of Patents and Trademarks